US011583719B2

(12) United States Patent
Weisz

(10) Patent No.: US 11,583,719 B2
(45) Date of Patent: Feb. 21, 2023

(54) EXERCISE CHAIR UTILIZING AN ADJUSTABLE RESISTANCE BAND SYSTEM

(71) Applicant: Evan Mark Weisz, New York, NY (US)

(72) Inventor: Evan Mark Weisz, New York, NY (US)

( * ) Notice: Subject to any disclaimer, the term of this patent is extended or adjusted under 35 U.S.C. 154(b) by 291 days.

(21) Appl. No.: 15/467,942

(22) Filed: Mar. 23, 2017

(65) Prior Publication Data

US 2018/0339181 A1 Nov. 29, 2018

Related U.S. Application Data

(60) Provisional application No. 62/313,088, filed on Mar. 24, 2016.

(51) Int. Cl.
*A63B 21/055* (2006.01)
*A63B 21/00* (2006.01)
(Continued)

(52) U.S. Cl.
CPC ..... *A63B 21/0442* (2013.01); *A47C 1/00* (2013.01); *A47C 7/24* (2013.01); *A47C 7/543* (2013.01);
(Continued)

(58) Field of Classification Search
CPC ..... A63B 21/0442; A63B 23/04; A63B 23/12; A63B 21/1609; A63B 21/0555; A63B 22/0605; A63B 21/4035; A63B 21/4034; A63B 23/1209; A63B 23/0405; A63B 23/03575; A63B 23/03541; A63B 23/03525; A63B 21/0557; A63B 21/0414; A63B 21/4047; A63B 21/00065;
(Continued)

(56) References Cited

U.S. PATENT DOCUMENTS 1,973,945 A * 9/1934 Chavin ..... A61G 13/009 482/130
4,373,716 A * 2/1983 Pagani ..... A63B 21/0004 482/130
(Continued)

FOREIGN PATENT DOCUMENTS

EP 2606941 A1 6/2013
GB 2415150 A * 12/2005 ..... A63B 21/04
(Continued)

*Primary Examiner* — Sundhara M Ganesan
*Assistant Examiner* — Shila Jalalzadeh Abyaneh
(74) *Attorney, Agent, or Firm* — Rumit Ranjit Kanakia

(57) ABSTRACT

An exercise chair includes a chair frame, and a base fixed with the chair frame that is adapted to support the exercise chair on a floor surface. The base and chair frame have a plurality of anchors projecting away therefrom. A cushion may cover at least a portion of the frame. Multiple resistance bands each have multiple longitudinal slots therethrough, each adapted for selective fixing with any of the anchor knobs or several attachable exercise devices. In use, with the person seated in the chair and the chair resting on the support surface, one or two of the resistance bands can be fixed with any of the anchor knobs, so that the person can exercise by pushing and/or pulling the at least one resistance band. Different types of attachments are included for exercising varying muscle groups.

21 Claims, 16 Drawing Sheets

(51) Int. Cl.

| | |
|---|---|
| ***A63B 23/035*** | (2006.01) |
| ***A63B 23/12*** | (2006.01) |
| ***A63B 23/04*** | (2006.01) |
| ***A63B 21/16*** | (2006.01) |
| ***A47C 1/00*** | (2006.01) |
| ***A47C 7/24*** | (2006.01) |
| ***A63B 21/04*** | (2006.01) |
| ***A63B 22/06*** | (2006.01) |
| ***A47C 7/54*** | (2006.01) |
| ***A47C 7/62*** | (2006.01) |
| *A63B 71/00* | (2006.01) |

(52) U.S. Cl.

CPC ..... *A47C 7/62* (2013.01); *A63B 21/0414* (2013.01); *A63B 21/0555* (2013.01); *A63B 21/0557* (2013.01); *A63B 21/1609* (2015.10); *A63B 21/4034* (2015.10); *A63B 21/4035* (2015.10); *A63B 22/0605* (2013.01); *A63B 23/03525* (2013.01); *A63B 23/03541* (2013.01); *A63B 23/03575* (2013.01); *A63B 23/04* (2013.01); *A63B 23/0405* (2013.01); *A63B 23/12* (2013.01); *A63B 23/1209* (2013.01); *A63B 21/00065* (2013.01); *A63B 21/4047* (2015.10); *A63B 22/0694* (2013.01); *A63B 71/0036* (2013.01); *A63B 2225/09* (2013.01); *A63B 2225/093* (2013.01)

(58) Field of Classification Search

CPC ..... A63B 2225/093; A63B 2225/09; A63B 22/0694; A63B 71/0036; A63B 21/16; A63B 21/4027; A63B 2210/00; A63B 2210/02; A63B 2210/04; A47C 1/00; A47C 7/24; A47C 7/543; A47C 7/62; A47C 9/002

USPC ..... 297/488, 466

See application file for complete search history.

(56) References Cited

U.S. PATENT DOCUMENTS

| | | | | |
|---|---|---|---|---|
| 4,597,605 | A * | 7/1986 | Gilbert | A47C 7/0213 297/228.1 |
| 4,856,775 | A | 8/1989 | Colledge et al. | |
| 5,044,633 | A * | 9/1991 | Rice | A63B 21/1609 482/138 |
| 5,234,394 | A | 8/1993 | Wilkinson | |
| 5,486,150 | A | 1/1996 | Randolph | |
| 5,755,650 | A | 5/1998 | Urso | |
| 5,833,587 | A | 11/1998 | Strong | |
| 5,871,425 | A * | 2/1999 | Gvoich | A63B 21/055 482/123 |
| 6,117,056 | A | 9/2000 | Cataldi | |
| 6,238,324 | B1 | 5/2001 | MacMillan | |
| 6,461,283 | B1 * | 10/2002 | Maron | A63B 21/023 482/123 |
| 6,500,104 | B1 | 12/2002 | Rich | |
| 6,634,998 | B2 * | 10/2003 | Siaperas | A63B 21/04 482/123 |
| 6,764,433 | B1 * | 7/2004 | Sims | A63B 21/0552 482/139 |
| 7,137,935 | B2 | 11/2006 | Clarke et al. | |
| 7,322,907 | B2 | 1/2008 | Bowser | |
| 7,326,157 | B2 | 2/2008 | Wu | |
| 7,361,127 | B2 * | 4/2008 | Tremayne | A63B 21/16 482/121 |
| 7,387,599 | B1 | 6/2008 | Hsu | |
| 7,413,533 | B2 | 8/2008 | Lin | |
| 7,537,553 | B2 | 5/2009 | Mongelluzzo | |
| 7,699,762 | B2 | 4/2010 | Turnbull | |
| 7,708,670 | B2 | 5/2010 | Bowser | |
| 7,727,131 | B2 | 6/2010 | Longo | |
| 7,896,786 | B1 | 3/2011 | Osbourne | |
| 7,935,036 | B2 | 5/2011 | Haynes | |
| 9,220,966 | B2 | 12/2015 | Garner | |
| 2005/0187082 | A1 | 8/2005 | Bowser | |
| 2006/0052224 | A1 | 3/2006 | Kellogg | |
| 2007/0099780 | A1 | 5/2007 | Bowser | |
| 2007/0270292 | A1 * | 11/2007 | Laney | A63B 21/0552 482/121 |
| 2008/0081748 | A1 * | 4/2008 | Knapp | A63B 21/4043 482/130 |
| 2008/0106132 | A1 * | 5/2008 | Glockl | A47C 7/004 297/264.1 |
| 2008/0203776 | A1 * | 8/2008 | Mongelluzzo | A63B 21/4035 297/118 |
| 2009/0017999 | A1 * | 1/2009 | Halbridge | A63B 23/1209 482/130 |
| 2009/0233773 | A1 * | 9/2009 | Cardey | A63B 21/16 482/121 |
| 2010/0016133 | A1 * | 1/2010 | Isacowitz | A63B 21/04 482/130 |
| 2010/0323861 | A1 * | 12/2010 | Karwan | A47C 7/40 482/145 |
| 2011/0183825 | A1 * | 7/2011 | Yang | A63B 21/4039 482/132 |
| 2011/0207585 | A1 * | 8/2011 | Burns | A61F 5/0123 482/124 |
| 2011/0237410 | A1 | 9/2011 | Perez | |
| 2012/0058867 | A1 * | 3/2012 | Mishan | A63B 21/023 482/140 |
| 2012/0065039 | A1 * | 3/2012 | Alessandri | A63B 21/0552 482/142 |
| 2012/0295778 | A1 | 11/2012 | Johansson | |
| 2014/0084646 | A1 * | 3/2014 | Benden | A47C 7/62 297/217.1 |
| 2014/0274603 | A1 | 9/2014 | Howes | |
| 2015/0126345 | A1 * | 5/2015 | Kaye | A63B 21/00065 482/129 |
| 2017/0156501 | A1 * | 6/2017 | Grove | A47C 7/462 |

FOREIGN PATENT DOCUMENTS

| | | | |
|---|---|---|---|
| JP | 2007259972 | A * | 10/2007 |
| WO | WO03/103455 | A1 * | 12/2003 |

* cited by examiner

EXERCISE CHAIR UTILIZING AN ADJUSTABLE RESISTANCE BAND SYSTEM

CROSS-REFERENCE TO RELATED APPLICATIONS

This application claims the benefit of US Provisional Patent Application 62/313,088, filed on Mar. 24, 2016, and incorporated herein by reference.

STATEMENT REGARDING FEDERALLY SPONSORED RESEARCH AND DEVELOPMENT

Not Applicable.

FIELD OF THE INVENTION

This invention relates to exercise devices, and more particularly to a resistance-band type exercise device in combination with a chair.

DISCUSSION OF RELATED ART

Exercise devices are well known in the prior art, most requiring significant floor space. Further, many exercise machines are design for facilitating only a few different exercises, and thus multiple exercise machines must be provided if a person is going to exercise a wide variety of muscle groups. The typical gym is outfitted with dozens of different machines.

For those not able or desiring to exercise at a gym, and particularly for those who are seated in an office chair for many hours a day, a combination office chair and exercise chair would be beneficial if the product offered a wide enough variety of different exercises that could be adjusted to individual strengths and exercise needs.

Therefore, there is a need for a device that is a combination office or desk chair and an exercising chair. Such a low-profile chair would allow for a wide variety of different exercises, and would include a variety of easily-attached accessories for facilitating additional exercises. Such a needed invention would be durable, relatively easy to manufacture and use, and relatively inexpensive when compared with traditional exercise machines. The present invention accomplishes these objectives.

SUMMARY OF THE INVENTION

The present device is an exercise chair for a person to use while sitting in the chair. The exercise chair may also be used as a low-profile office chair or desk chair. A chair frame includes a back support frame fixed at a lower side thereof with a back end of a seat frame. Each frame includes at least one knob aperture adapted for selective fixing with an upper anchor knob fixed with and projecting laterally away from a side edge of one of the frames.

Two optional side arms may be fixed each with one of the side edges of the back support frame. The side arms each project away from a front side of the back support frame. Each side arm is preferably selectively rotationally positionable between a stowed position, used when performing exercises, and an extended position, used when the exercise chair is being used as an office chair.

A base is fixed with a lower end of the seat frame and is adapted to support the exercise chair on a support surface, such as a floor. The base has at least one lower anchor knob aperture for receiving one of the anchor knobs projecting away therefrom. Preferably the base includes a central vertical shaft fixed at a top end thereof with a shaft receiver mechanism fixed with the lower end of the seat frame. A lower end of the central vertical shaft terminates in a plurality of base legs projecting downwardly away therefrom, each base leg adapted for contacting the support surface at a distal end thereof. Each base leg preferably includes a wheel, such that the exercise chair may be rolled along the support surface.

Preferably the central vertical shaft includes a telescoping mechanism and a height adjustment actuator such that when the height adjustment actuator is actuated, the height of the vertical shaft can be adjusted. Further, preferably the shaft receiver mechanism further includes a tilt mechanism and a tilt actuator, such that when the tilt actuator is actuated, the tilt of the chair frame may be adjusted with respect to the base.

At least one optional cushion, mesh cover, or the like may cover at least a portion of the frames. Such a cushion may cover the entire chair frame except for the upper anchor knobs that project away therefrom. Where the at least one cushion covers the side edges of the frames, a plurality of extension tubes may be included for traversing the resilient cover so that the upper anchor knobs are not covered by the at least one cover.

An inner framework of both the upper and lower sections of the chair may be comprised of individual modular sections. These sections are composed of interconnected tubes configured in a grid pattern. The individual sections align in such a way that an inner tube can be placed through an adjacent section towards a central column of both the back support frame and the seat frame of the chair. The inner tube of each section is connected with a horizontally fixed tube to form a T-bar which can be extended, either from the top of the chair or the front of the chair. Once extended, the T-bar can be fixed into position with a fastening pin, for example, in order to conduct exercises.

Inner tubes also extend from the horizontally configured tubes in the individual sections and can be extended out and fixed in place for exercises. The horizontal inner tubes have threaded sleeves fixed in their outward facing sections. These sleeves are used in conjunction with the threaded anchor knobs to fasten the slotted resistance band for exercise. The individual sections may also have at least two threaded apertures to fix the sections to the outer frame of the chair. In this way, individual sections can be attached and removed from the frame for easy repair.

At least one elastomeric resistance band has a plurality of longitudinal slots therethrough, each adapted for selective fixing with any of the threaded anchor knobs or attachable exercise devices. The threaded anchor knobs cooperate with both the slotted resistance band and several attachable exercise devices. When not in use, the knob can be positioned in a more flush position against the chair cover, cushion or frame for a relatively low-profile appearance. When the person wishes to engage in exercise, the anchor knob can be unscrewed and an exercise device or resistance band can be placed snugly around the anchor knob.

Once fixed on the knob, the adjustable band or device can be secured to the frame by screwing the anchor knob down to the frame. The anchor knobs are located in a plurality of places on the chair and the resistance bands have a plurality lengths and longitudinal slots. More than one resistance band can be used in a stacked configuration to increase the resistance. Further, multiple types of resistance bands can be used each having differing thicknesses for different resistances. The resistance bands can be attached to each other with a connector for adding length to the band, and the resistance bands can be made of varying lengths. As such, the resistance bands can be easily reconfigured and repositioned on any of the anchor knobs for a wide variety of individualized exercises with a wide variety of resistance levels.

The resistance bands can also be attached to slotted anchoring devices that are built into the chair. For attachment, a resistance band or bands are place on a safety hook and then the safety hook is attached to the slotted anchor fixed on the chair. Preferably each resistance band includes an attachable handle.

In use, with the person seated in the chair and the chair resting on the support surface, the at least one resistance band can be fixed with any of the anchor knobs, so that the person can exercise by pushing and/or pulling the at least one resistance band with an attachable handle or other attachable exercise device In one embodiment, two side back cushions and two side seat cushion are selectively fixable to the upper anchor knobs to cover the upper anchor knobs and extend the at least one cushion about the side edges, of the frames. In some embodiments, a plurality of horizontal anchor bars are exposed in the side back cushions and the side seat cushions to provide additional anchor points with which to fix one of the resistance bands, such a resistance band terminating in a carabiner or hook.

In some embodiments, a top side of the back support frame further includes an extendible first T-bar having two opposing ends, each terminating at a T-bar anchor knob, around which the longitudinal slot of each resistance band may be fastened. The first T-bar is positionable between a retracted position above the back support frame. Similarly, a front side of the seat frame may further include an extendible second T-bar having two opposing ends each terminating at a T-bar anchor knob around which the longitudinal slot of each resistance band may be fastened. The second T-bar is positionable between the retracted position, similarly to the first T-bar, but in front of or below the seat frame. The second T-bar lies flush therewith when in the retracted position. It is understood that herein the use of "anchor knob" also implies an optional anchor aperture with a removable anchor knob.

The second T-bar is further pivotally attached with the seat frame. Holes are located on the pivoting device such that the second T-bar can be fixed in the extended position for pulling exercises, or it can rotate to a lowered position and fixed for leg lift exercises. Preferable the T-bars can stow away in a cushioned section that blends into the outer sections, or stows away under the visible section of the seat for a low profile look. This flap is attached to the cushion or cover material on the chair. When the person wishes to engage the T-bar device, the flap can be opened and the T-bar can be extended.

The exercise chair may further include an attachment bar fixable at each end thereof with one end of one of the resistance bands. The other end of the resistance band is fixed with one of the anchor knobs, such that the person may push or pull the attachment bar to exercise his arms or legs.

The exercise chair may further include a curved tube attachment. One or more resistance bands are threaded through the curved tube, and opposing ends of each resistance band are fixed with one of the anchor knobs. The curved tube can be used both as a handle on the upper part of the chair and as a leg lift device on the lower part of the chair.

A pair of brackets adapted to engage at least two of the upper anchor knobs each includes a cup extending from a side wall of the bracket, laterally away from the back seat frame. Each cup faces upright and is adapted to hold a U-bar attachment rotationally therein. Each U-bar attachment is fixed together around a back side of the back support frame with at least one of the resistance bands. As such, the person seated in the chair can insert his elbows or forearms into one of the U-bar attachments and squeeze his arms together to exercise the arms and pectoral muscles.

In some embodiments, a pedal assembly may be fixed to the base at the at least one lower anchor knob with at least one of the resistance bands. The pedal assembly is positioned in front of the exercise chair such that the person may use the pedal assembly with his feet engaged with rotating pedals. This exercise offers an aerobic style of exercise as well as resistance exercise.

In some embodiments, an elastic band with slots may be fixed to the anchors on the base of the chair. Another longer elastic band is then threaded between those slots to create loops at the feet or ankle level. Both bands are attached to anchor knobs. Exercises can then be performed by alternately pulling and pushing legs in the opposite direction of each other.

Optionally a carrying bag is included with the exercise chair. This carrying bag has multiple compartments that can hold the resistance bands, the exercise attachments and other paraphernalia used with the exercise chair.

The present invention is a combination office or desk chair and an exercising chair. The present low-profile exercise chair provides for a wide variety of different exercises, and includes a number of easily-attached accessories for facilitating additional exercises. The present invention is durable, relatively easy to manufacture and use, and relatively inexpensive when compared with traditional exercise machines. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
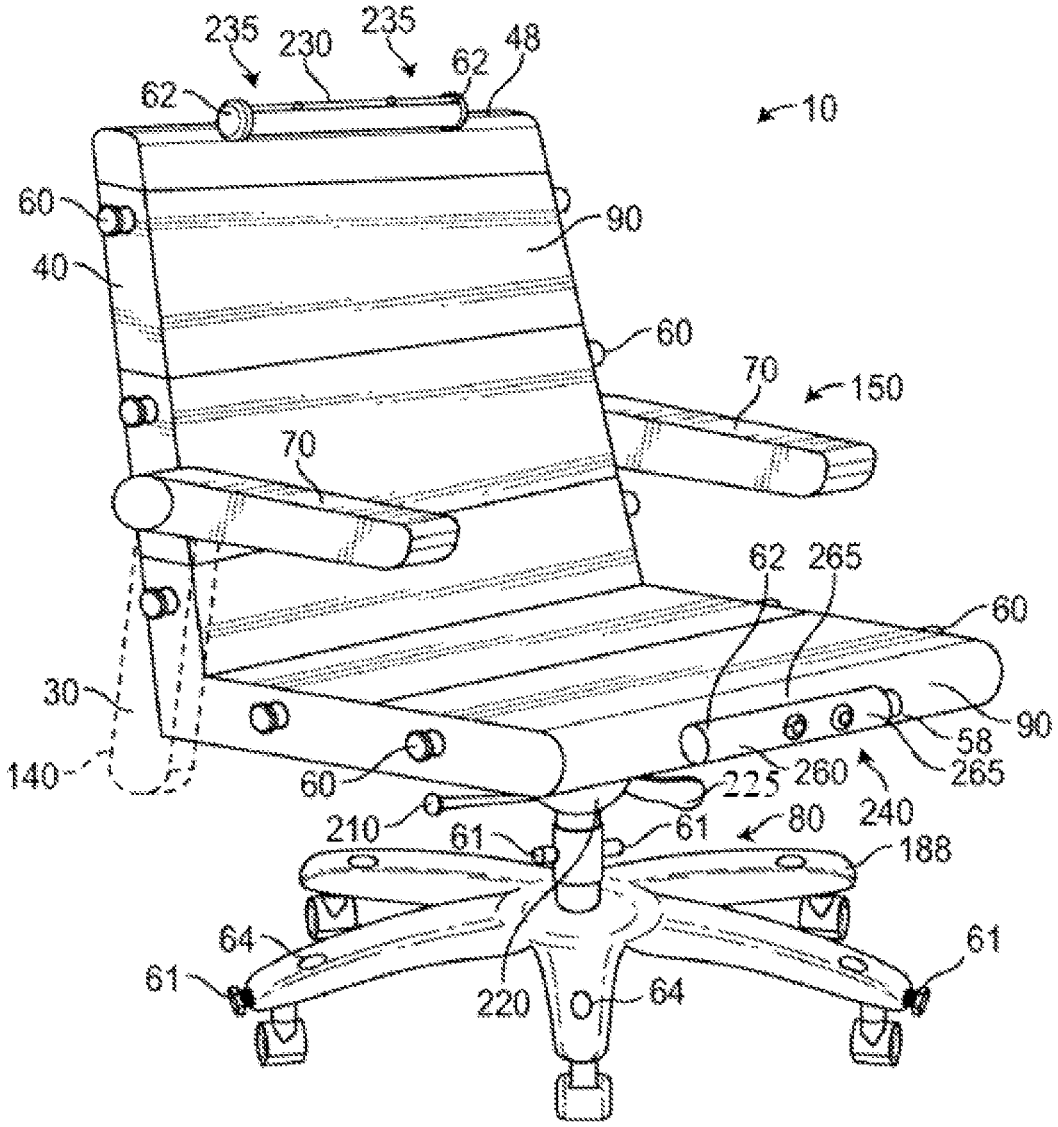
FIG. 1 is a perspective view of the invention.
Figure 2:
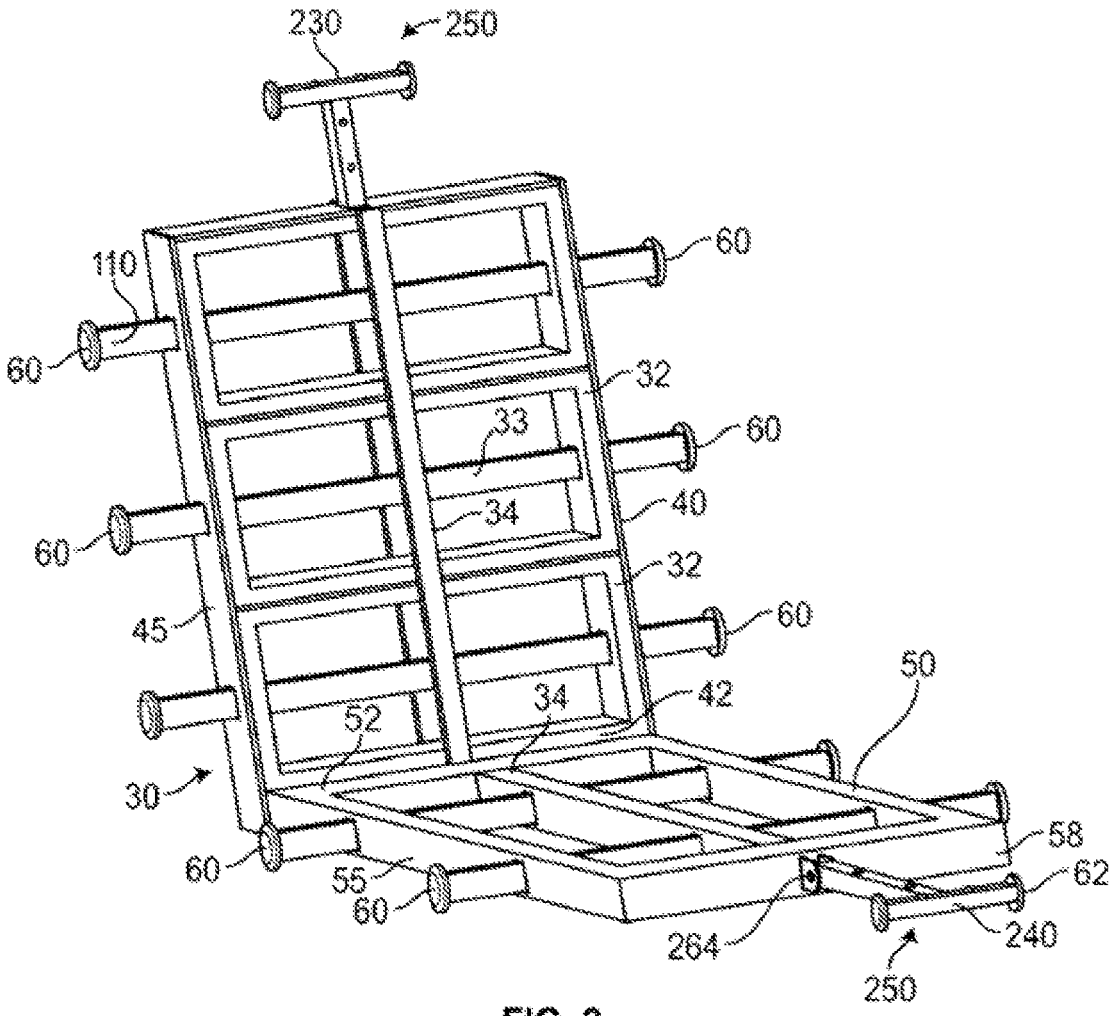
FIG. 2 is a perspective view of a chair frame of the invention, illustrated without a cover.

FIGS. 1 and 2 illustrate an exercise chair 10 for a person 20 to use while sitting in the chair 10. The exercise chair 10 may also be used as an office chair or desk chair. While an embodiment having a chair back is shown in the figures, it is not required that the chair 10 includes a back support frame 40, instead taking a stool configuration (not shown) as opposed to a chair configuration as shown (FIG. 1).

Figure 14:
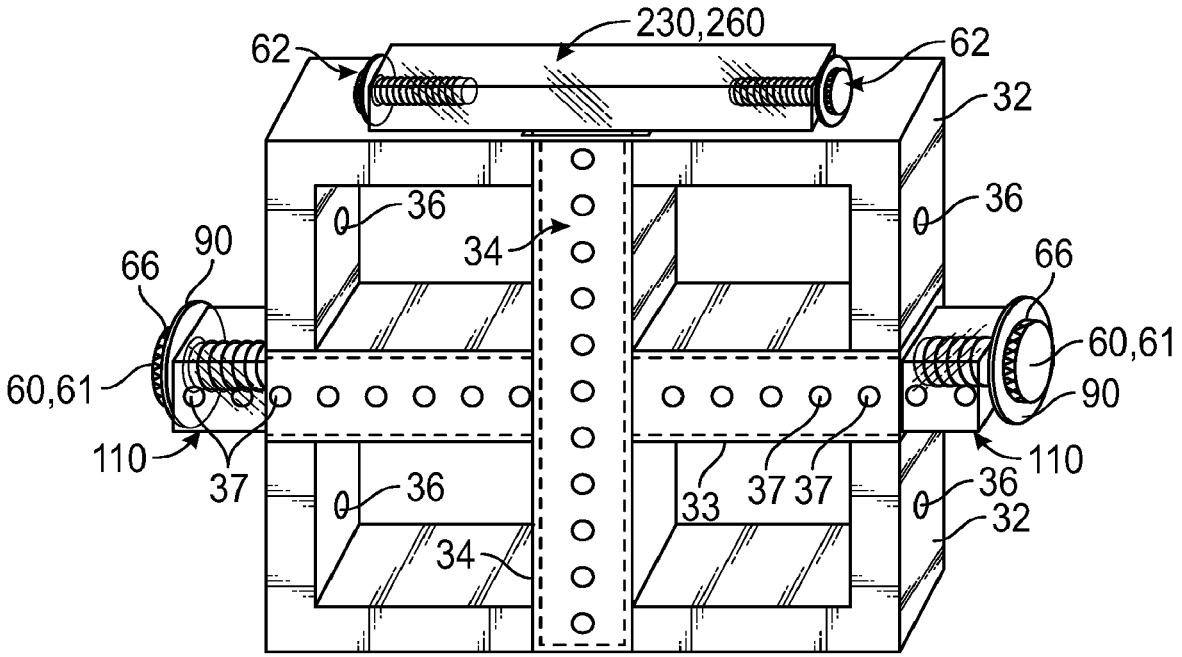
FIG. 14 is a perspective view of an interchangeable frame section of the invention.

A rigid chair frame 30 includes the back support frame 40 fixed at a lower side 42 thereof with a back end 52 of a seat frame 50. Each frame 40,50 includes at least one upper anchor knob 60 fixed with a side edge 45,55 of one of the frames 40,50. Each upper anchor knob 60 projects laterally away from the frames 40,50. Each frame 40,50 may be telescoping so that each upper anchor knob 60 may be extended away from the chair frame 30 some distance in order to accommodate various exercises (FIG. 2). Further, each section of the back support frame 40 and the seat frame 50 may be made from modular sections 32 (FIG. 14) that are interchangeable, so that if one section is damage it may be readily replaced by another spare section. Preferably the frames 40,50 are made from a rigid metal material.

Two rigid, pivotal side arms 70 are each preferably fixed with one of the side edges 45 of the back support frame 40. The side arms 70 each project away from a front side 41 of the back support frame 40. Each side arm 70 is preferably selectively rotationally positionable between a stowed position 140 and an extended position 150. Alternately, the side arms 70 may take a T-shape (not shown) and be fixed with the seat frame 40 and project upwardly therefrom.

Figure 4:
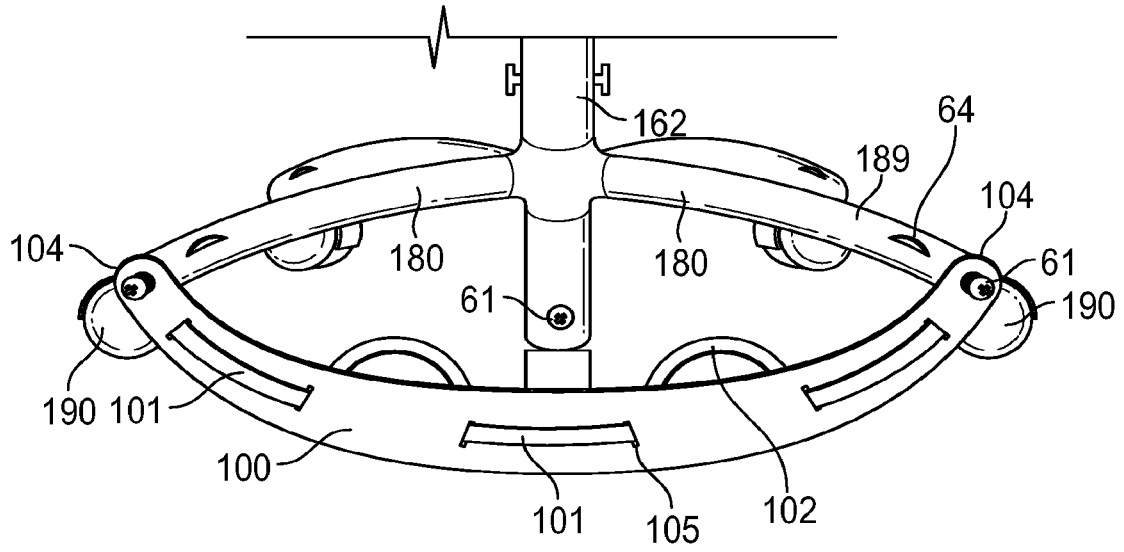
FIG. 4 is a partial perspective view of a base of the invention, illustrating a resistance band stretched between two lower anchor knobs.

A base 80 is fixed with a lower end 59 of the seat frame 50 and is adapted to support the exercise chair 10 on a support surface 15, such as a floor (FIG. 1). The base 80 has at least one lower anchor knob 61 projecting away therefrom and/or at least one anchor aperture 64 traversing through a top 189 of the base leg 180 (FIG. 4). Preferably the base 80 includes a central vertical shaft 160 fixed at a top end 168 thereof with a shaft receiver mechanism 170 fixed with the lower end 59 of the seat frame 50. A lower end 162 of the central vertical shaft 160 terminates in a plurality of base legs 180 projecting downwardly away therefrom, each base leg 180 adapted for contacting the support surface 15 at a distal end 188 thereof. Each base leg 180 preferably includes a wheel 190, such that the exercise chair 10 may be rolled along the support surface 15.

Preferably the central vertical shaft 160 includes a telescoping mechanism 200 and a height adjustment actuator 210 such that when the height adjustment actuator 210 is actuated, the height of the vertical shaft 160 can be adjusted. In such an embodiment, the telescoping mechanism 200 is biased towards a fully extended position without a load, and with a load (such as the person 20 sitting on the chair 10) the telescoping mechanism 200 is urged into a retracted position.

Further, preferably the shaft receiver mechanism 170 further includes a tilt mechanism 220 and a tilt actuator 225, such that when the tilt actuator is actuated, the tilt of the chair frame 30 may be adjusted with respect to the base 80.

Alternately the base 80 includes at least three downwardly-projecting vertical legs (not shown) as is common in the art. However, unlike the prior art, such vertical legs also include at least one lower anchor knob 61 projecting away therefrom. Each such vertical leg may also include one of the wheels 190.

At least one cushion or cover 90 preferably covers at least a portion of the frames 40,50. Such a cushion 90 may cover the entire chair frame 30 except for the upper anchor knobs 60 that project away therefrom. Where the at least one cushion 90 covers the side edges 45,55 of the frames 40,50, a plurality of extension tubes 110 may be included for traversing the resilient cover 90 so that the upper anchor knobs 60 are not covered by the at least one cover 90.

In some embodiments, an inner framework of both the back support frame 40 and the seat frame 50 of the exercise chair 10 may be comprised of individual, modular sections 32. These modular sections are composed of interconnected tubes 33 configured in a grid pattern. The individual sections 32 align in such a way that each inner tube 33 can be placed through an adjacent section towards a central column 34 of both the back support frame 40 and the seat frame 50 of the exercise chair 10. This inner tube 33 is connected with a horizontally fixed tube to form a T-Bar 230,260. The T-bar 230,260 can be extended both from the top of the chair 10 and the front of the chair 10. Once extended it can be fixed into position with fastening pins through position apertures 37 in order to conduct exercises.

Inner tubes 33 can also extend from horizontally configured extension tubes 110 in the individual sections 32 and be fixed in place for exercises. The horizontal extension tubes 110 have threaded sleeves or receivers 305 fixed in their outward facing sections. These sleeves 305 are used in conjunction with the threaded anchor knobs 60,61,62 to fasten a slotted resistance band 100 for exercise. The individual sections 32 also have at least two threaded holes 36 to fix the sections 32 to the outer frame 30 of the chair 10. In this way, individual sections 32 can be attached and removed from the frame 30 for easy repair.

Figure 8:
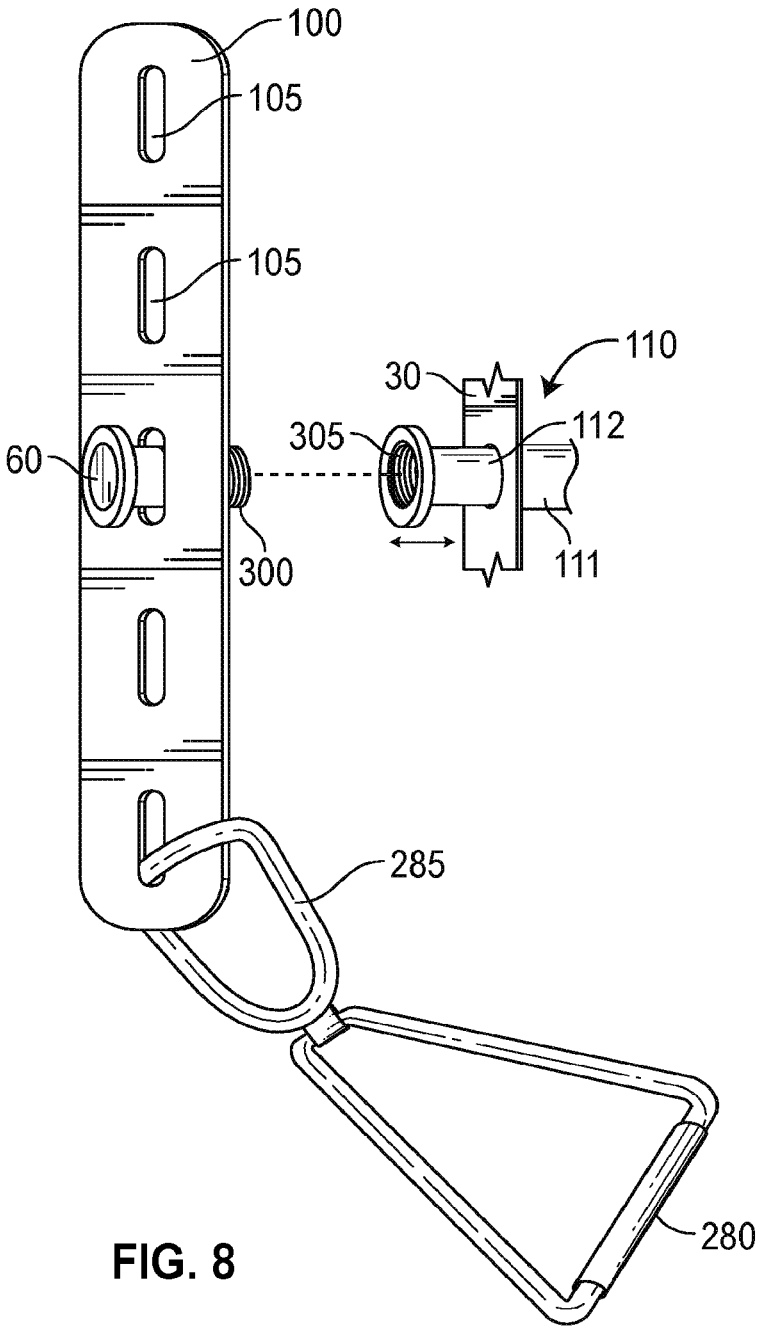
FIG. 8 is an enlarged perspective view of one embodiment of the resistance band, showing a handle fixed therewith and a threaded anchor knob and threaded receiver therefore.

In some embodiments, the extension tubes 110 are telescoping and laterally extendable as desired by the person 20 for performing exercises or for retracting the extension tubes 110 and upper anchor knobs 60 into the side edges 45,55 of the chair frame 30. For example, each extension tube 110 comprises a first fixed sleeve 111 and a second inner extendible tube 112 captured within the first fixed sleeve 111, the extendible tube 112 including the threaded receiver 305 (FIG. 8). The at least one cushion or cover 90 includes an outer surface with a foam or other pliable material therein. Alternately the cushion 90 may be a mesh material (not shown).

At least one elastomeric resistance band 100 has a plurality of longitudinal apertures 106 or slots 105 therethrough, each adapted for selective fixing with any of the anchor knobs 60,61 or exercise devices. The slots 105 preferably fit snugly around the anchor knobs 60,61 to create a secure fit. The anchor knobs 60,61 are low-profile and only extend far enough away from the cover 90 or the frame 30 that two or three resistance bands 100 may be engaged therewith. If desired, each resistance band 100 may be tightened to the frame 30 by screwing-in the anchor knobs 60,61 manually, with a hex tool, or the like (not shown). Alternately various accessories such as a pedal assembly 290, an attachment bar 310, handles 320, and U-bar attachments 350 (see below) can also be engaged with the anchor knobs 60,61.

At least one elastomeric resistance band 100 has a plurality of longitudinal slots 105 or apertures 106 therethrough, each adapted for selective fixing with any of the threaded anchor knobs 60,61,62 or attachable exercise devices. The anchor knobs 60,61,62 are adapted to cooperate with both the slotted resistance bands 100 and attachable exercise devices (described below). When not in use, each anchor knob 60,61,62 can be positioned in a more flush position against the cover 90 or frame 30 for a low-profile appearance. When the person 20 wishes to engage in exercise, one of the anchor knobs 60,61,62 can be unscrewed and an exercise device or resistance band 100 can be placed snugly around the anchor knob 60,61,62. Once fixed on the anchor knob 60,61,62, the adjustable band 100 or device can be secured with the frame 30 by screwing the anchor knob 60,61,62 down to the frame 30.

Figure 15:
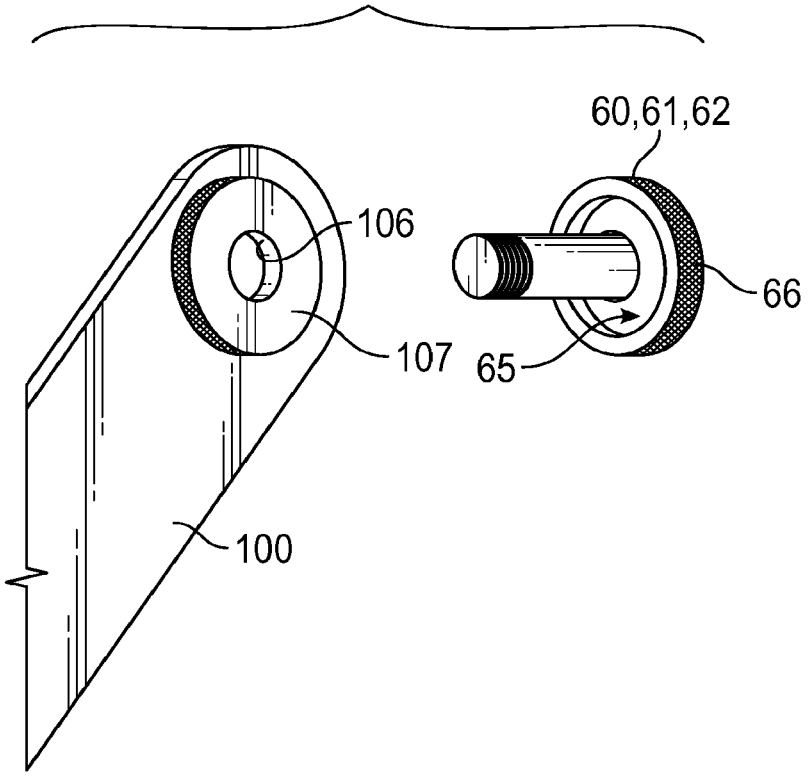
FIG. 15 is an exploded partial perspective view of an alternate embodiment of the resistance band and anchor knob.
Figure 16:
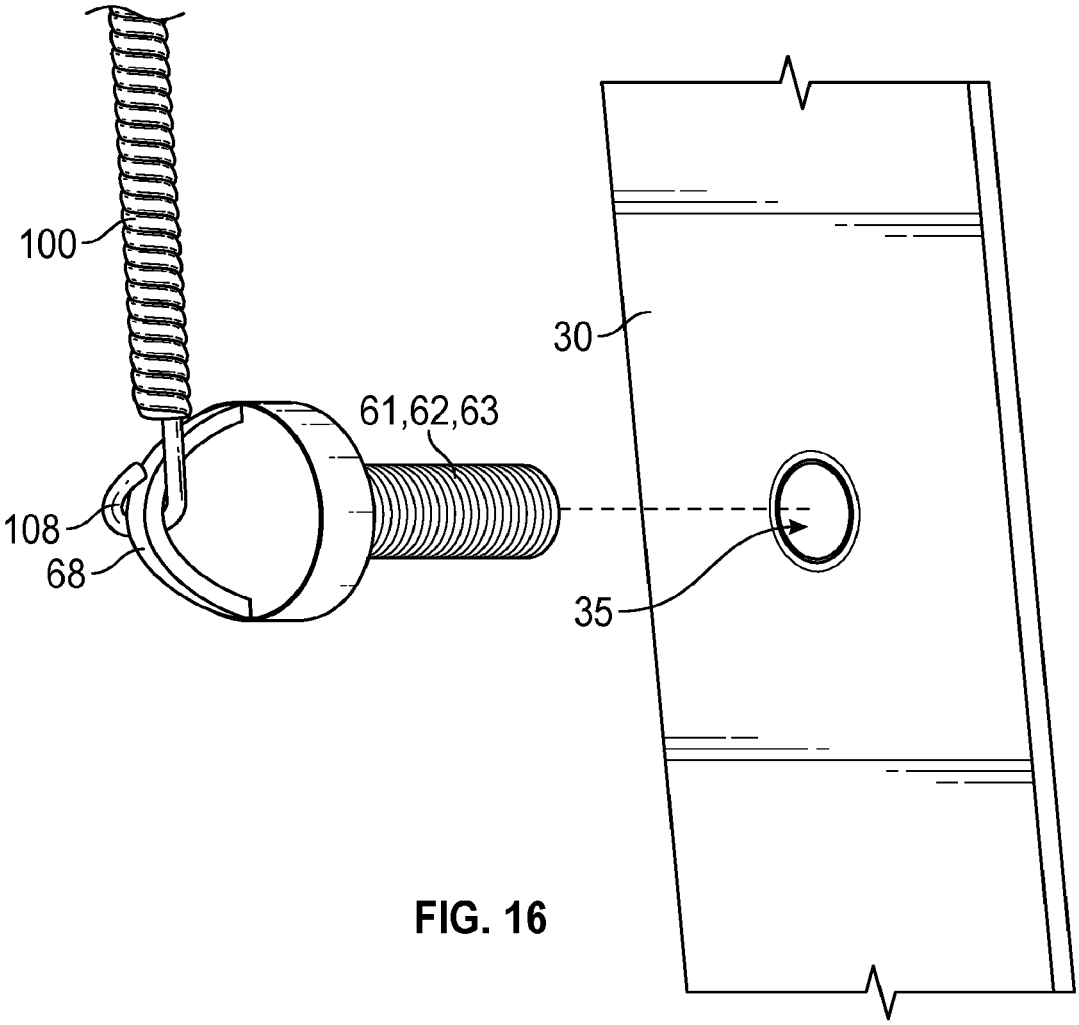
FIG. 16 is an exploded partial perspective view of an alternate embodiment of the anchor knob and a resistance band having a hook.
Figure 17:
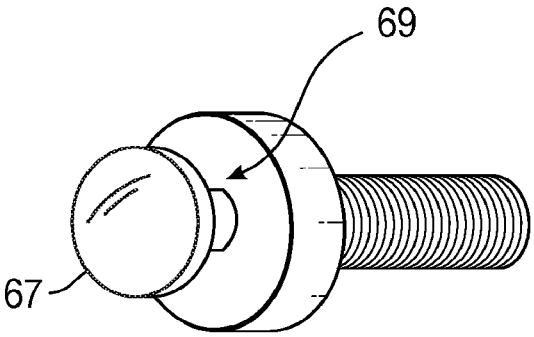
FIG. 17 is a perspective view of an alternate embodiment of the anchor knob that can accept a resistance band with either a hook, slot or aperture therein.

In some embodiments, at least one of the resistance bands 100 includes a raised, reinforced section 107 (FIG. 15) around the anchor aperture 106 thereof, each anchor knob 60,61,62 including a recessed portion 65 cooperative with the raised, reinforced section 107 to rotationally capture the resistance band 100 on the anchor knob 60,61,62 when the anchor knob 60,61,62 is fixed with the resistance band 100 and fully engaged with one of the threaded receivers 305. In some embodiments the resistance band 100 includes a hook 108 adapted for insertion into one of the anchor apertures 64, or through a loop 68 of one of the anchor knobs 60 (FIG. 16), or around a waist 69 of a capped anchor knob 67 (FIG. 17).

The anchor knobs 60,61,62 are located in a plurality of places on the chair 10 and the resistance bands 100 have a plurality lengths and longitudinal slots 105. More than one resistance band 100 can be used in a stacked configuration to increase the resistance. Further, multiple types of resistance bands 100 can be used each having differing thicknesses for different resistances. The resistance bands 100 can be attached to each other with a connector 360 (FIG. 13D) for adding length to the band 100, and the resistance bands 100 can be made of varying lengths. As such, the resistance bands 100 can be easily reconfigured and repositioned on any of the anchor knobs 60,61,62 for a wide variety of individualized exercises with a wide variety of resistance levels. The resistance bands 100 can also be attached to slotted anchoring devices that are built into the chair 10. For attachment, a resistance band 100 may be positioned on the chair 10 with a safety hook (not shown) and then the hook attached to one of the slotted anchors of the chair 10.

Preferably each resistance band 100 includes an attachable handle 280 (FIG. 8), which may be attached to one of the longitudinal slots 105 with a carabiner clip 285 or the like. As such, the resistance bands 100 can be easily reconfigured and repositioned on any of the anchor knobs 60,61 for a wide variety of exercises. More than one resistance band 100 can be used in a stacked configuration to increase the resistance experienced by the person 20. Further, multiple types of resistance bands 100 can be used each having differing thicknesses for different resistances. The resistance bands 100 can be attached to each other with a connector 360 (FIG. 13D) for adding length to the bands 100, and the resistance bands 100 can be made of varying lengths for use during different types of exercises or for people of varying sizes.

In use, with the person 20 seated in the chair 10 and the chair 10 resting on the support surface 15, the at least one resistance band 100 can be fixed with any of the anchor knobs 60,61 so that the person can exercise by pushing and/or pulling the at least one resistance band 100, either with the handle 280, other accessory, or otherwise (FIGS. 13A-13H). A robust full-body workout can be achieved by assuming different positions on the exercise chair 10 and utilizing the resistance bands 100 in various configurations on an of the anchor knobs 60,61,62.

Figure 3B:
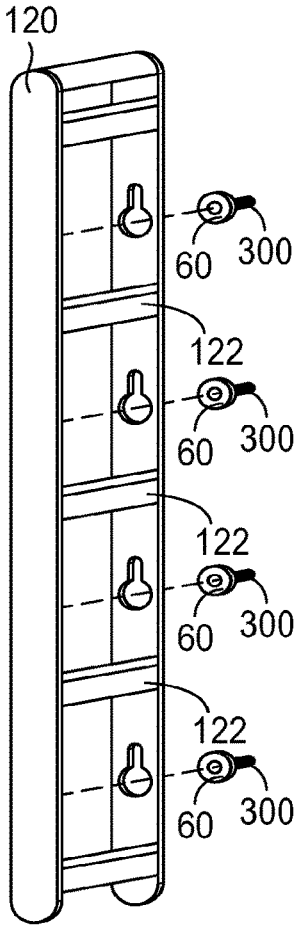
FIG. 3B is a is a rear perspective view of one of the side seat cushions of FIG. 3A, shown removed from the chair frame and shown with an exposed latticework of horizontal anchor bars.
Figure 3A:
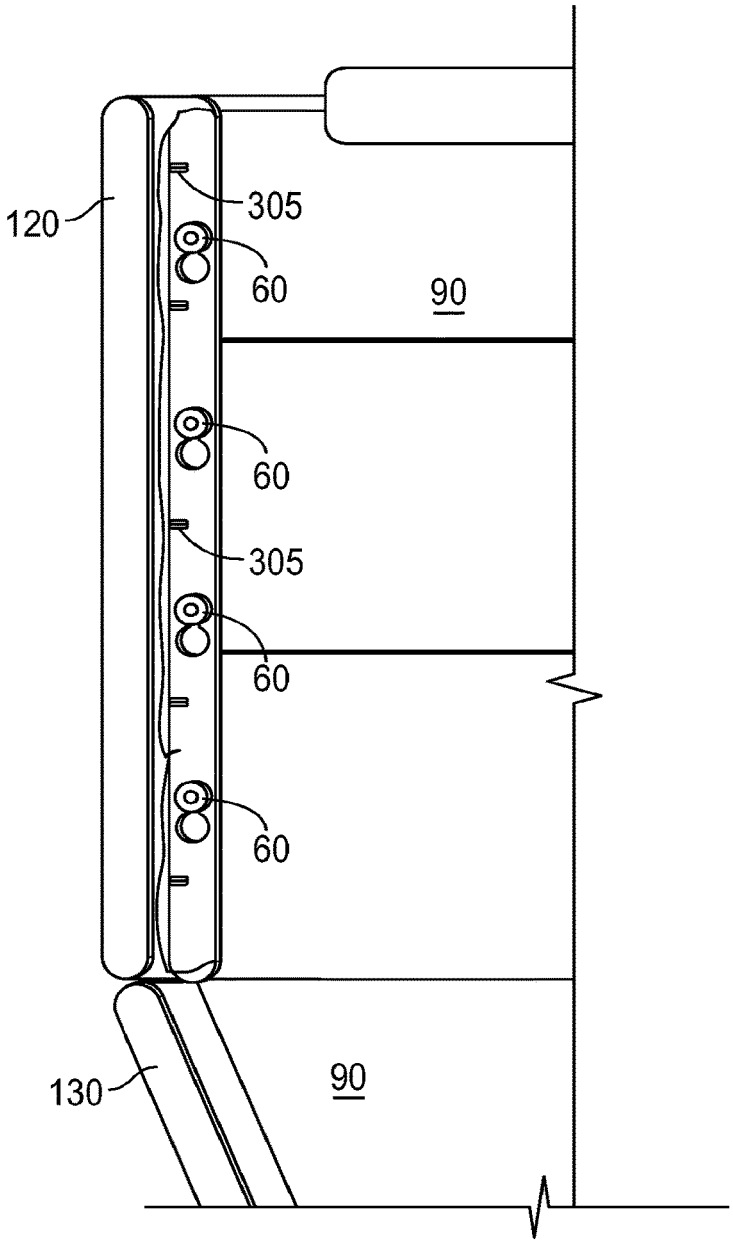
FIG. 3A is a partial perspective view of a back support frame of the invention, illustrating an optional side back cushion and a side seat cushion as attached to the chair frame, the side back cushion partially broken away to expose the interior thereof.

In one embodiment, two side back cushions 120 (FIGS. 3A and 3B) and two side seat cushion 130 are selectively fixable to the upper anchor knobs 60 to cover the upper anchor knobs 60 and extend the at least one cushion 90 about the side edges 45,55 of the frames 40,50. In some embodiments, a plurality of horizontal anchor bars 122 (FIG. 3B) are exposed in the side back cushions 120 and the side seat cushions 130 to provide additional anchor points with which to fix one of the resistance bands 100, such a resistance band 100 terminating in a carabiner or hook (not shown).

Figure 7:
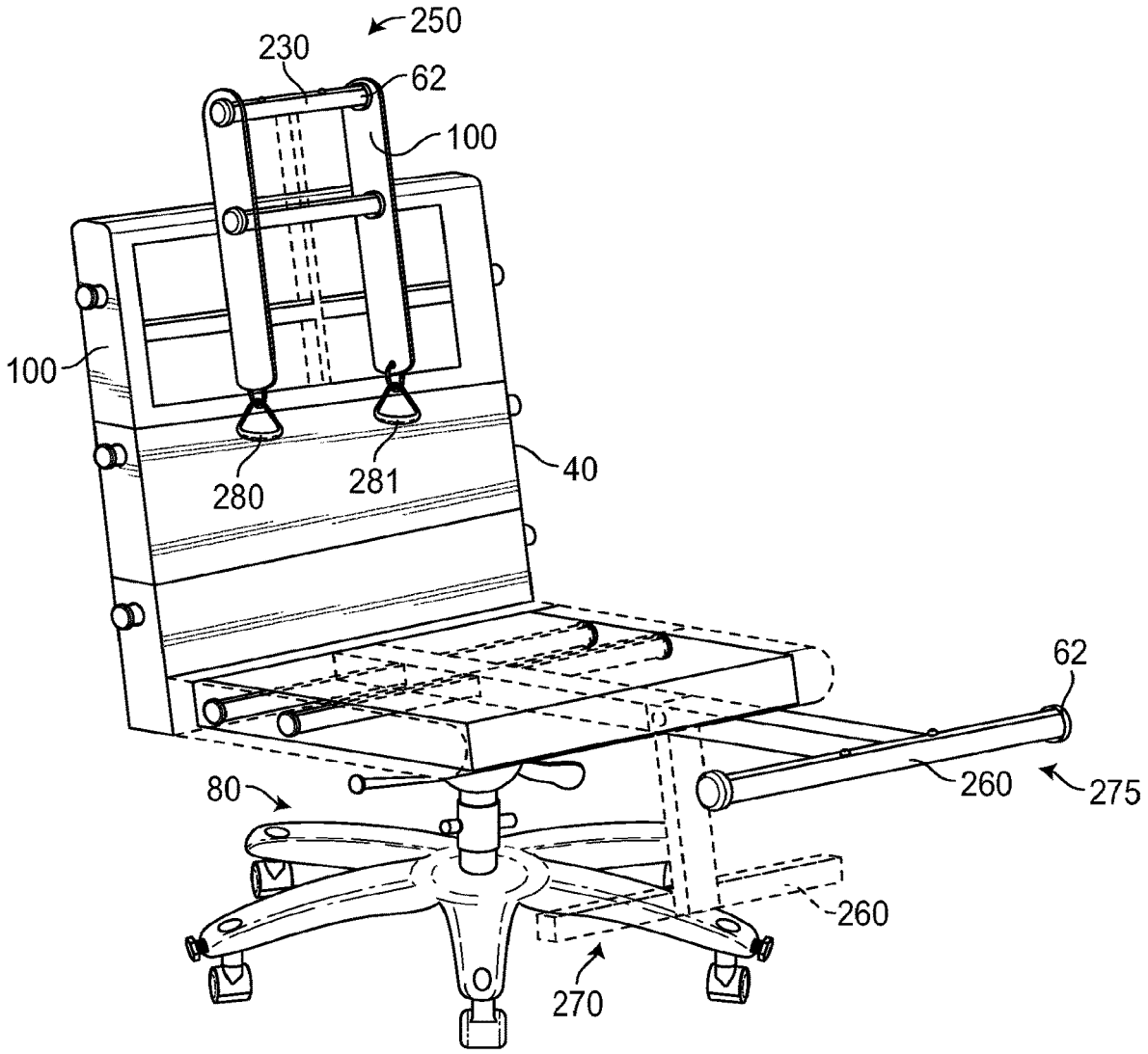
FIG. 7 is a perspective view of the invention, partially broken away to show the back support frame and a seat frame, and further showing a pair of T-bar assemblies of the invention.
Figure 13A:
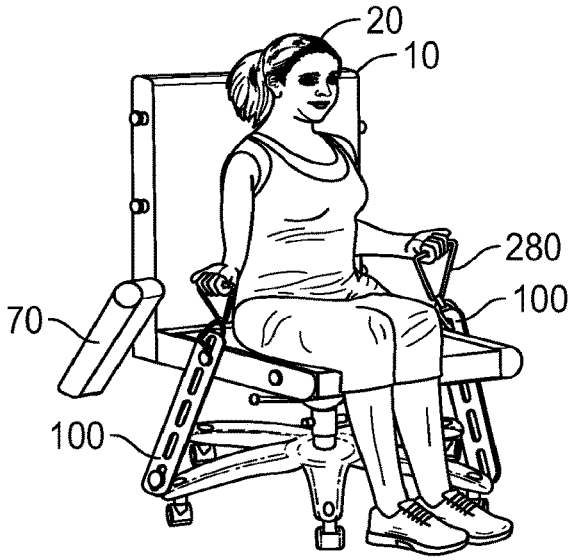
FIG. 13A is a perspective view of a person performing bicep exercises while sitting in the exercise chair of the present invention.
Figure 13B:
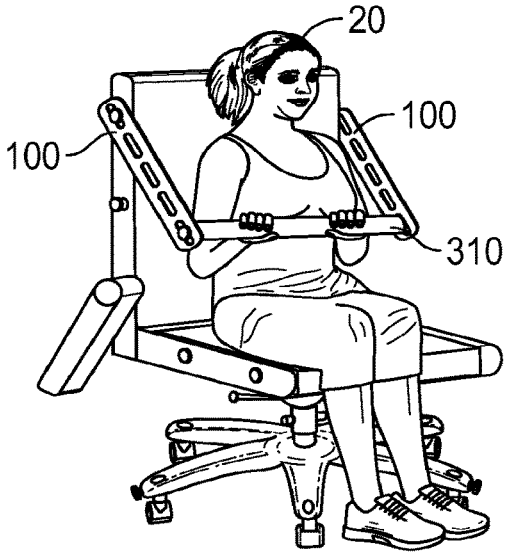
FIG. 13B is a perspective view of a person performing bench-press type exercises while sitting in the exercise chair of the present invention.
Figure 13C:
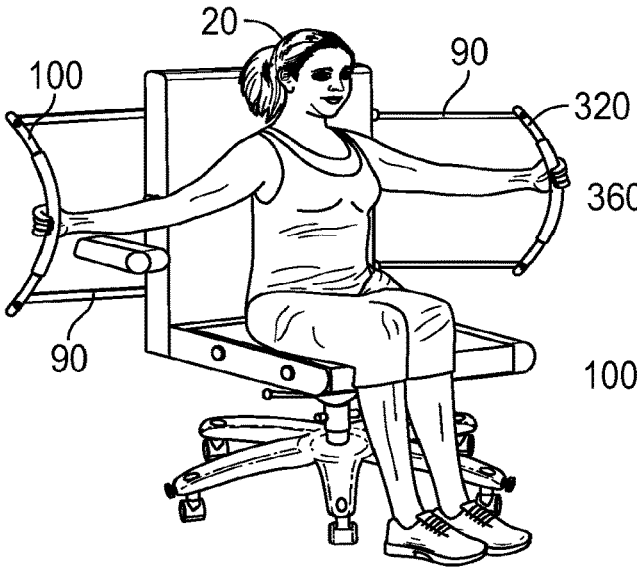
FIG. 13C is a perspective view of a person performing pectoral exercises while sitting in the exercise chair of the present invention.
Figure 13D:
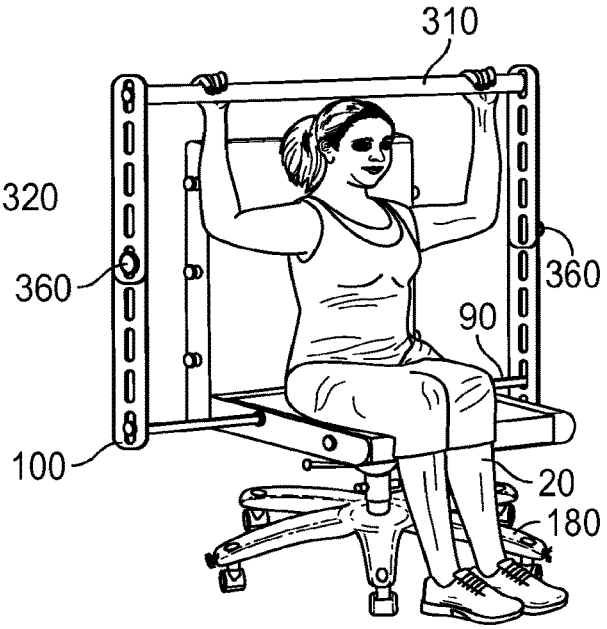
FIG. 13D is a perspective view of a person performing lift-type exercises while sitting in the exercise chair of the present invention.
Figure 13E:
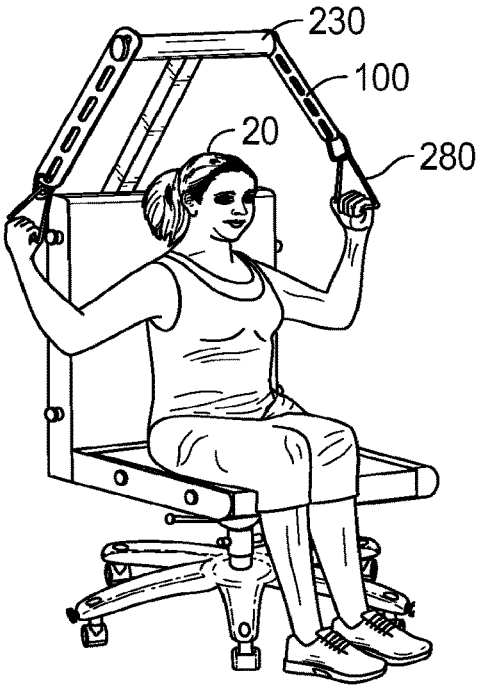
FIG. 13E is a perspective view of a person performing pull-up type exercises while sitting in the exercise chair of the present invention.
Figure 13F:
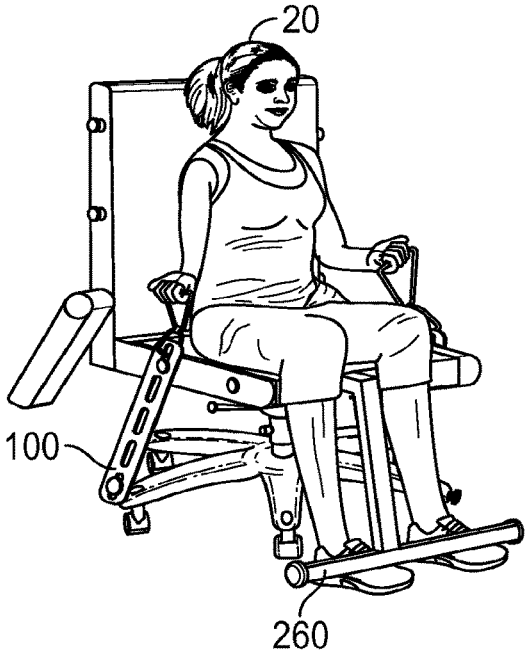
FIG. 13F is a perspective view of a person performing curl-type exercises while sitting in the exercise chair of the present invention.
Figure 13G:
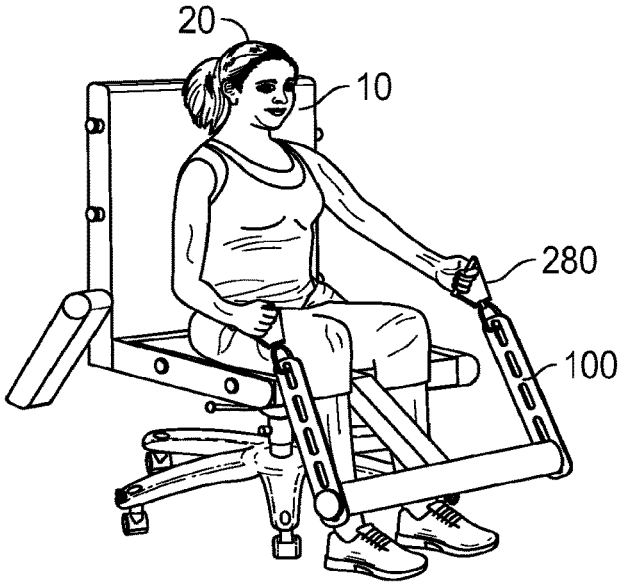
FIG. 13G is a perspective view of a person performing rowing-type exercises while sitting in the exercise chair of the present invention.
Figure 13H:
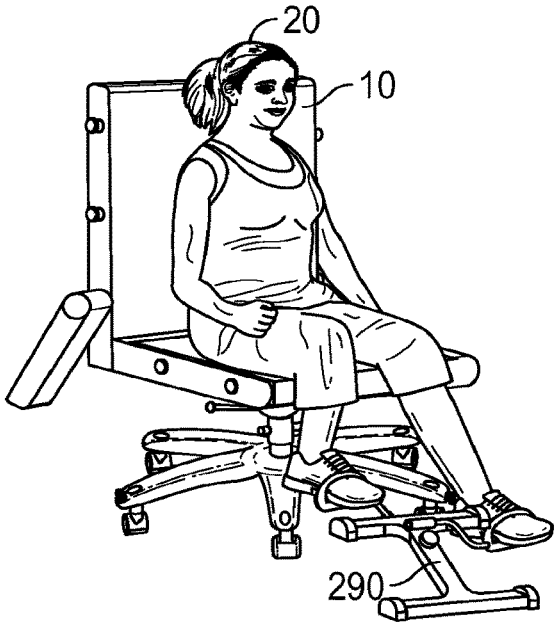
FIG. 13H is a perspective view of a person performing pedaling exercises while sitting in the exercise chair of the present invention.

In some embodiments, a top side 48 of the back support frame 40 further includes an extendible first T-bar 230 having two opposing ends 235, each terminating at a T-bar anchor knob 62, around which the longitudinal slot 105 of each resistance band 100 may be fastened. The first T-bar 230 is positionable between a retracted position 240 (FIG. 1 and an extended position 250 (FIG. 7) above the back support frame 40. The at least one cover 90 does not cover the extendible first T-bar 230, but preferably lies flush therewith when the first T-bar 230 is in the retracted position 240. Preferable, a flap (not shown) covers both T-bars 230,260 when they are in the retracted position 240 for a low profile look. This flap is attached to the cushioning or cover material 90 on the chair 10. When the person 20 wishes to engage one of the T bars 230,260, the flap can be opened and the T-bar 230,260 can be extended. The second T-bar 260 is further pivotally attached with the seat frame 30. Holes (not shown) are located on a pivot 264 such that when the second T-bar 260 is in the extended position 250, it can be fixed in a raised position 275 for pulling exercises (FIG. 13G), or the second T-bar 260 can rotate to a lowered position 270 for leg lift exercises (FIG. 13F).

In some embodiments, a front side 58 of the seat frame 50 further includes an extendible second T-bar 260 having two opposing ends 265, each terminating at a T-bar anchor knob 62, around which the longitudinal slot 105 of each resistance band 100 may be fastened. The second T-bar 260 is positionable between the retracted position 240 (FIG. 1 and the extended position 250 (FIG. 7), similarly to the first T-bar 230, but in front of the seat frame 50. The at least one cover 90 does not cover the extendible second T-bar 260, but preferably lies flush therewith when the second T-bar 260 is in the retracted position 240. The second T-bar 260 is further pivotally attached with the seat frame 50 such that when the second T-bar 260 is in the extended position 250, the second T-bar 260 may rotate between a raised position 275 for pulling exercises with hand grips (not shown), and a lowered position 270 for leg exercises.

Preferably each anchor knob 60,61,62 includes a threaded shaft 300 for screwing into a threaded receiver 305 of either one of the frames 40,50, the base 80, or the telescoping extension tubes 110. Such anchor knobs 60,61,62 may be screwed into the threaded receiver 305 with a hex-type tool, a regular screw driver (not shown), or the like. Alternately, each anchor knob 60,61,62 includes a knurled outer surface 66 (FIG. 15) to allow manually engaging the anchor knob 60,61,62 with the threaded receiver 305. Each anchor knob 60,61,62 includes a head 63 having a larger diameter than the threaded shaft 300 so that once the resilient band 100 is stretched over the head 63 at one of the longitudinal slots 105 thereof, the resilient band 100 is retained thereon until manually removed.

Figure 9:
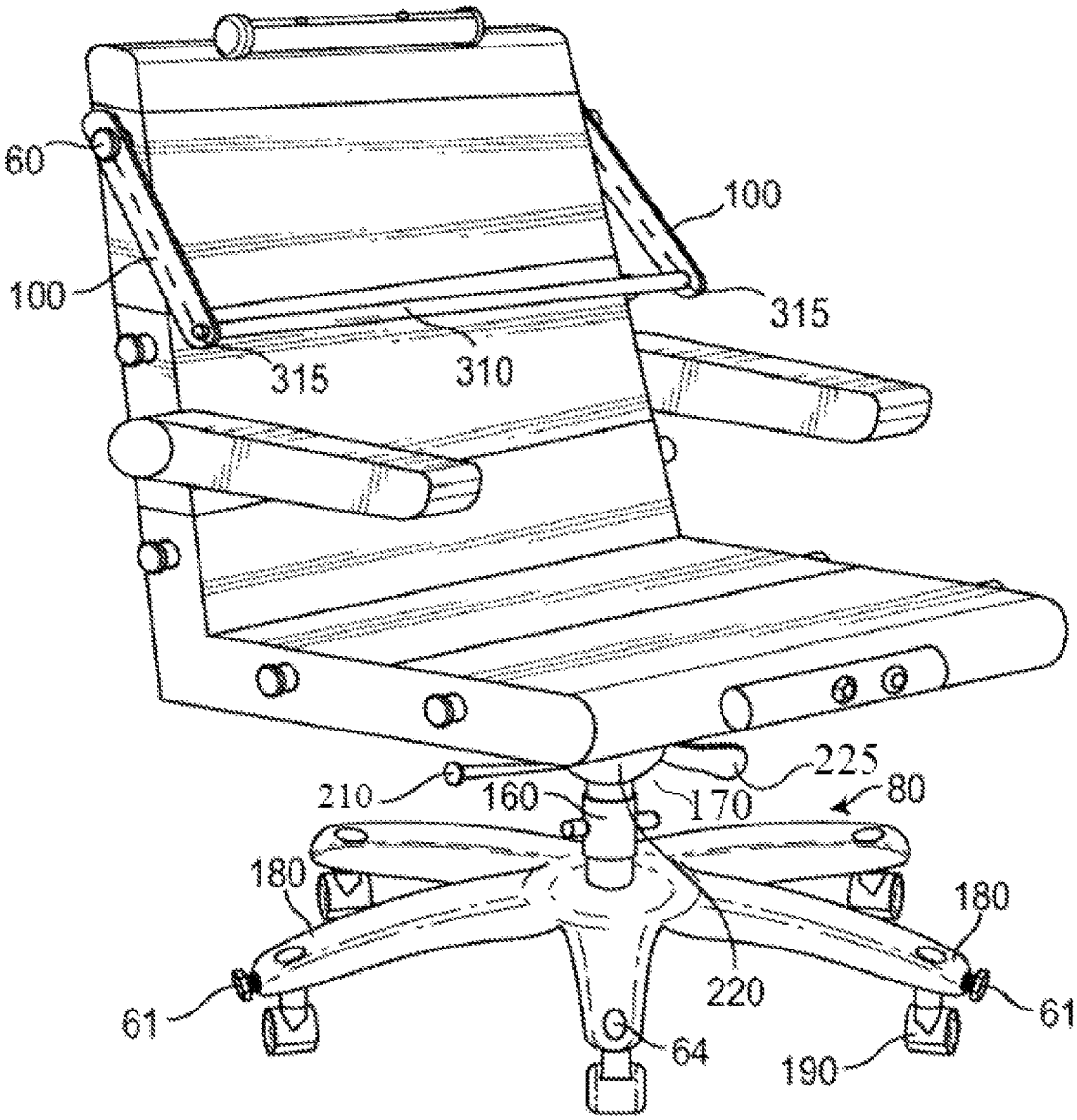
FIG. 9 is a perspective view of the invention, showing an optional attachment bar fixed to the chair frame with a pair of the resistance bands.

As illustrated in FIG. 9, the exercise chair 10 may further include an attachment bar 310 fixable at each end 315 thereof with one end 105 of one of the resistance bands 100. The other end 105 of the resistance band 100 is fixed with one of the anchor knobs 60,61 such that the person 20 may push or pull the attachment bar 310 to exercise his arms or legs.

Figure 5:
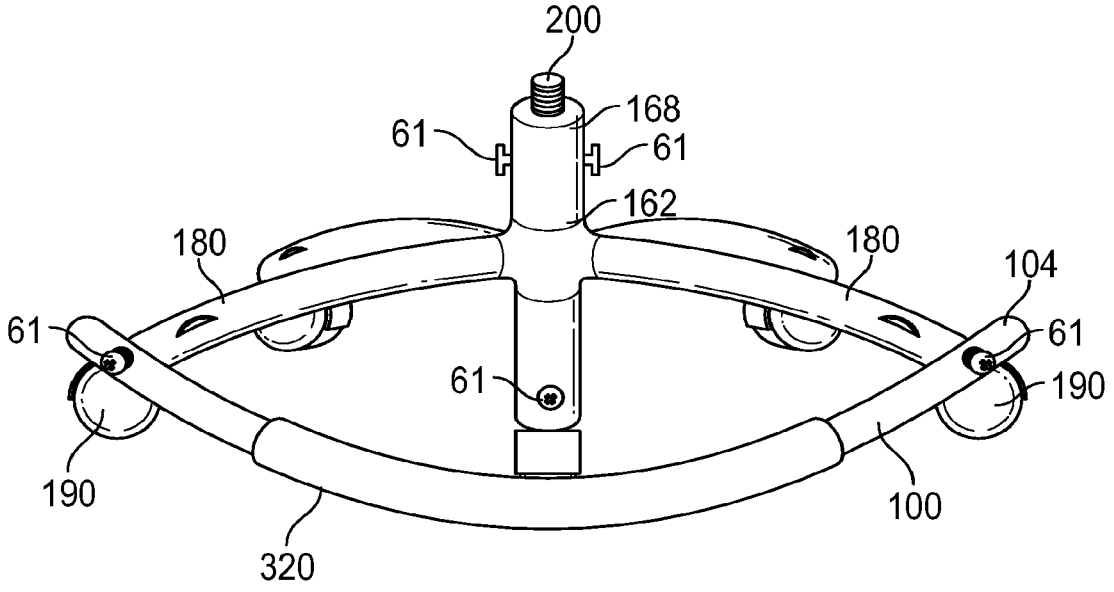
FIG. 5 is a partial perspective view of the base, showing one embodiment of the resistance band with a central curved handle.
Figure 12:
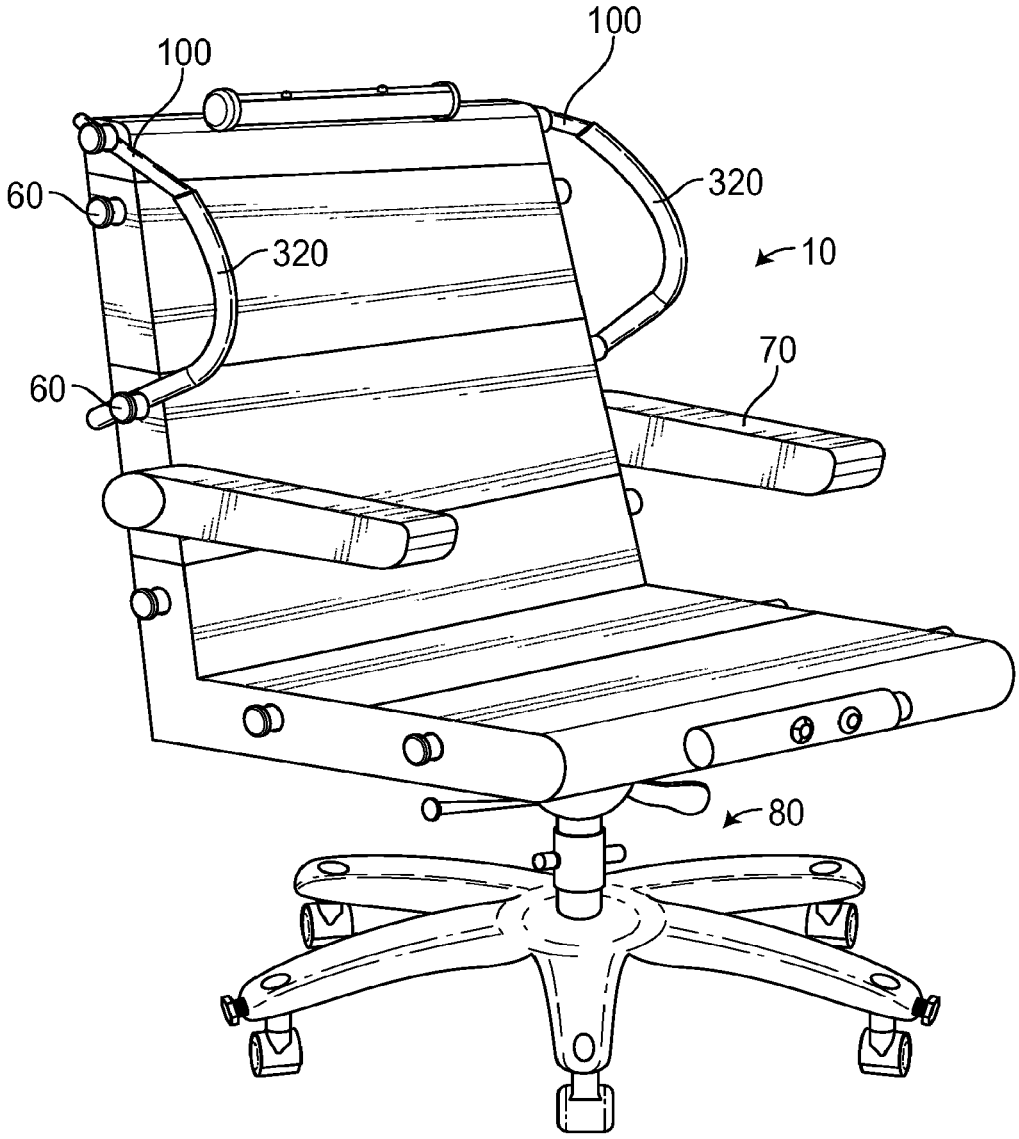
FIG. 12 is a perspective view of the invention shown with a pair of resistance bands having the central curved handle.

The exercise chair may further include a curved tube attachment 320. One or more of the resistance bands 100 are threaded through the curved tube attachment 320. Opposing ends 104 of each resistance band 100 are fixed with the anchor knobs 60,61,62. The curved tube attachment 320 can be used both as a handle on the back support frame 40 of the chair 10 and as a leg lift device on the base 80 of the chair 10. In some embodiments, at least two of the resistance bands 100 are included, each having the central curved handle 320 (FIGS. 5 and 12), wherein opposing ends 104 of each resistance band 100 are fixed with anchors 60,61, such as with the upper anchors 60 at a common side 45 of the back support frame 40 (FIGS. 12 and 13C). Such a central curved handle 320 is preferably a vinyl or other type of sleeve that facilitates gripping of the resistance band 100 manually.

Figure 10:
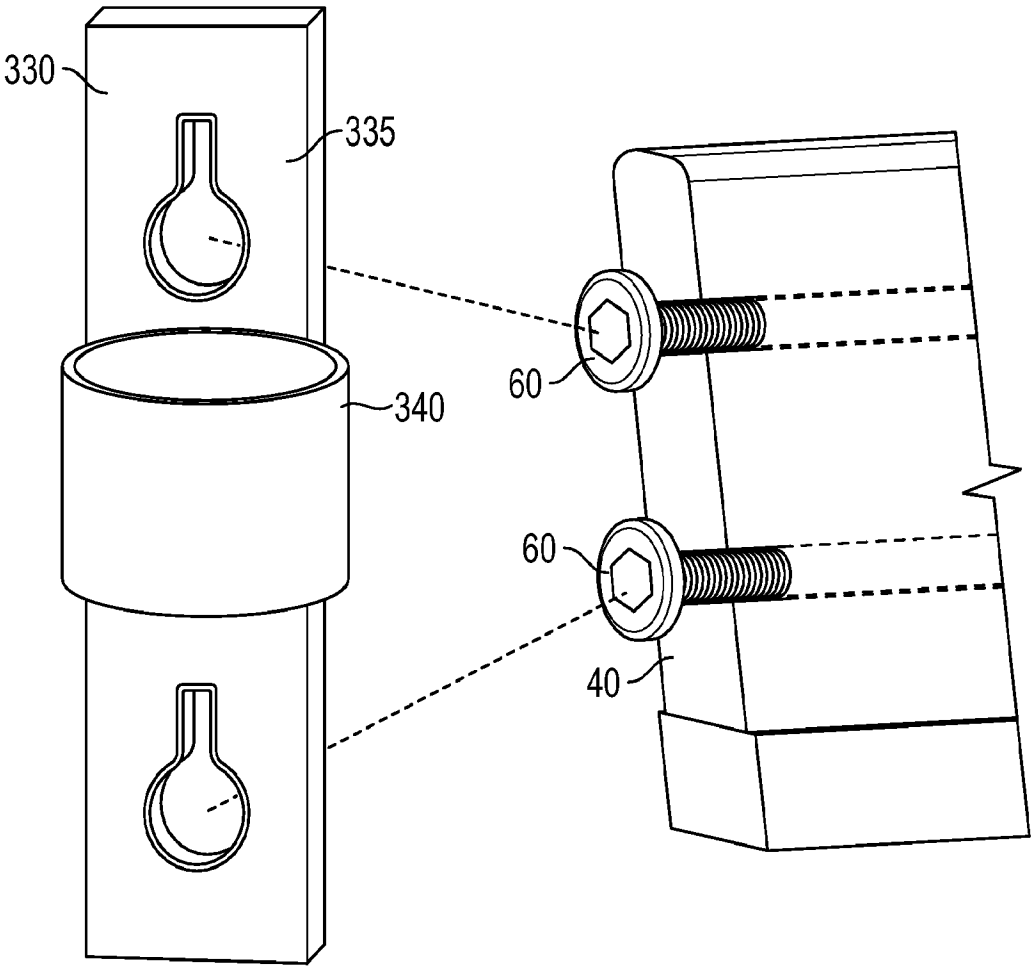
FIG. 10 is a partial perspective view of an embodiment having a bracket with a U-bar attachment.
Figure 11:
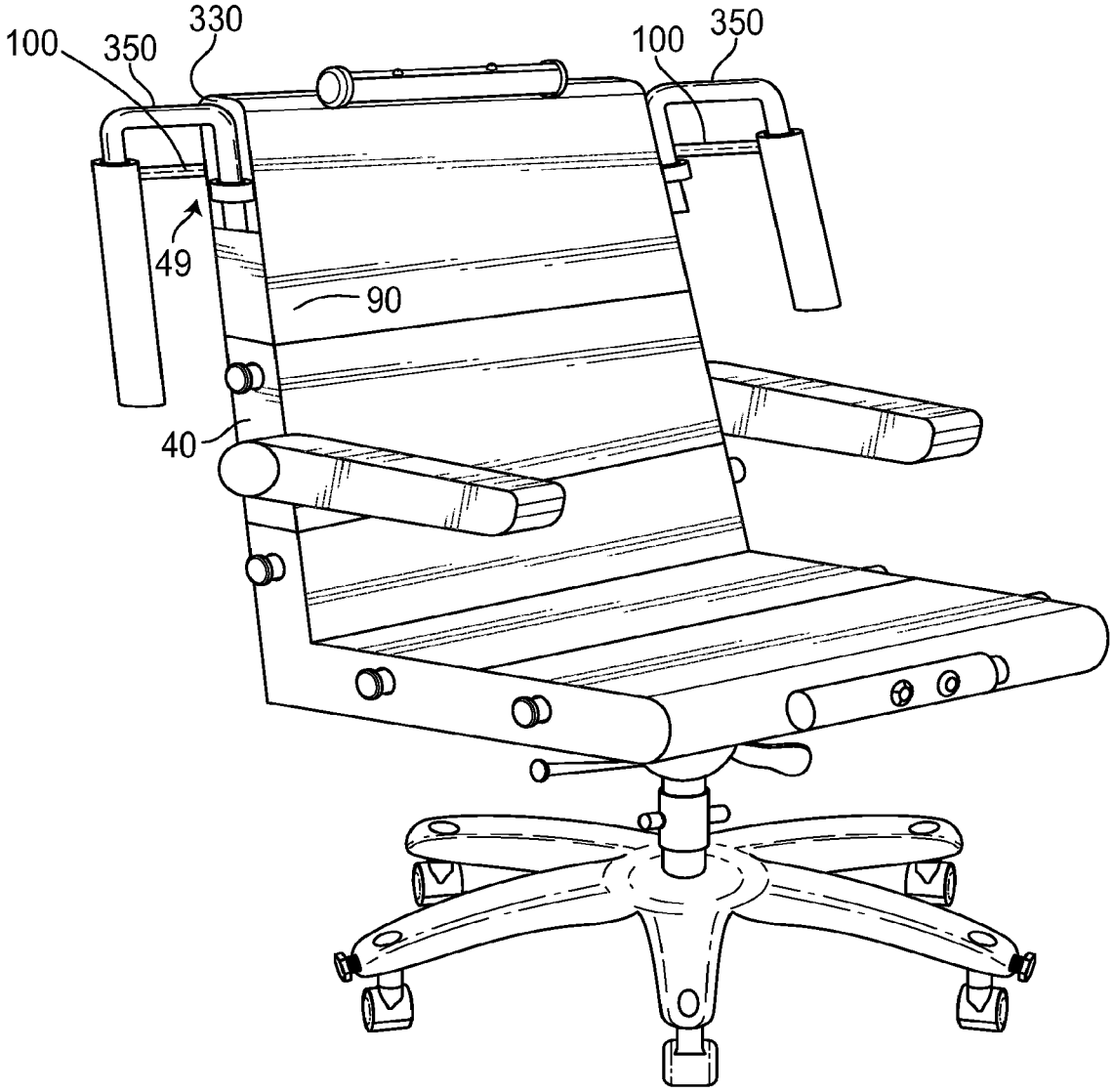
FIG. 11 is a partial perspective view of a pair of the brackets and U-bar attachments affixed to the chair with a resistance band stretched between the two U-bar attachments behind the chair.

FIGS. 10 and 11 illustrate a pair of brackets 330 adapted to engage at least two of the upper anchor knobs 60. Each bracket 330 includes a cup 340 extending from a side wall 335 of the bracket 330, laterally away from the back seat frame 40. Each cup 340 faces upright and is adapted to hold a U-bar attachment 350 rotationally therein. Each U-bar attachment 350 is fixed together around a back side 49 of the back support frame 40 with at least one of the resistance bands 100. As such, the person 20 seated in the chair 10 can insert his elbows or forearms into one of the U-bar attachments 350 and squeeze his arms together to exercise the arms and pectoral muscles.

Figure 6:
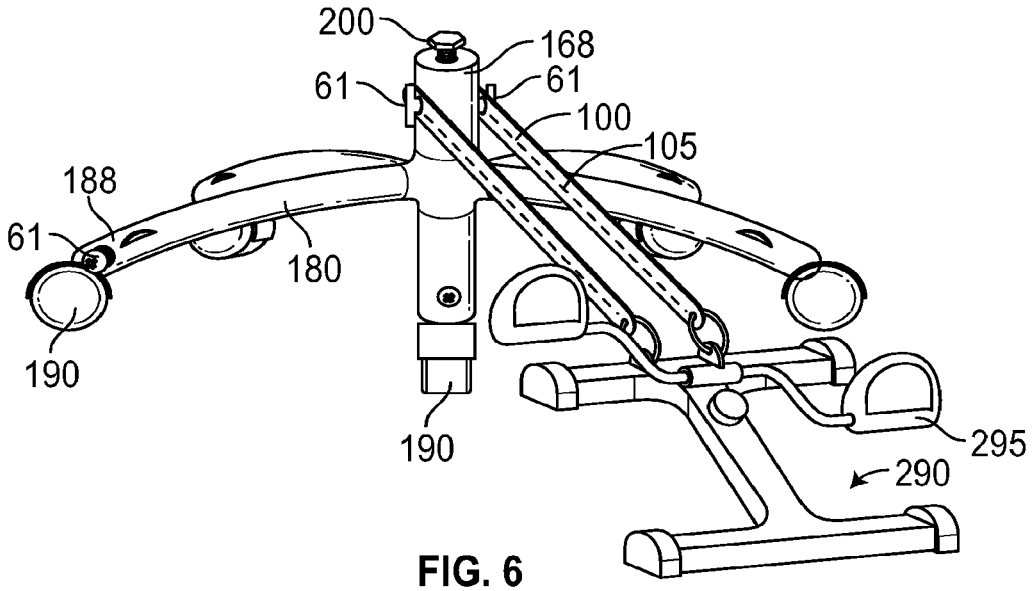
FIG. 6 is a partial perspective view of the base and a pedal assembly affixed thereto with two of the resistance bands.

In some embodiments, a pedal assembly 290 (FIG. 6) may be fixed to the base 80 at the at least one lower anchor knob 61 with at least one of the resistance bands 100. The pedal assembly 290 is positioned in front of the exercise chair 10 such that the person 20 may use the pedal assembly 290 with his feet engaged with rotating pedals 295. This exercise offers an aerobic style of exercise as well as resistance-based exercise.

In some embodiments, one of the elastic bands 100 with slots 105 or apertures 106 may be fixed to the lower anchors 61 on the base 80 of the chair 10. Another longer elastic band 101 (FIG. 4) is threaded between those slots 105 to create loops 102 at the feet or ankle level. Both bands 100,101 are attached to anchor knobs 61. Exercises are then performed by alternately pulling and pushing legs in the opposite direction of each other, the loops 102 fixed around the person's ankles.

In another embodiment, a carrying bag (not shown) is included with the exercise chair 10. This carrying bag has multiple different compartments that can hold the resistance bands 100, the exercise attachments and other paraphernalia used with the exercise chair 10.

Figure 18:
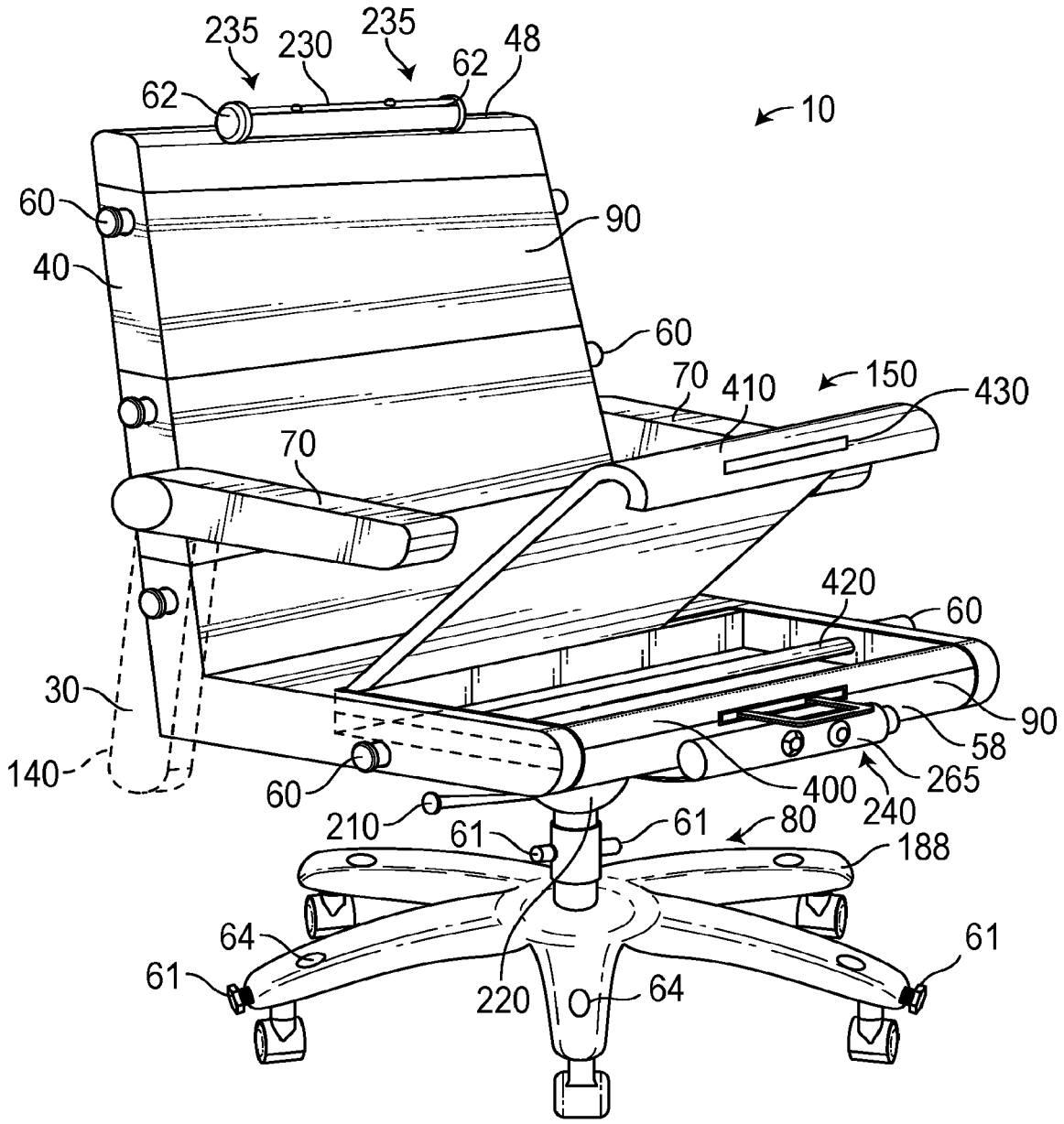
FIG. 18 is a perspective view of an embodiment of the invention having a portable storage case removable from the seat frame.

In another embodiment, a removable case 400 (FIG. 18) is selectively fixable with the seat frame 50, such that the seat frame 50 may store the case 400 while the case 400 is not in use. The removable case 400 has a selectively openable side 410 that allows access to an internal storage volume 420. The case 400 further preferably includes a carrying handle 430 and is adapted for holding a plurality of the resistance bands 100 and extension tubes 110. The case 400 further includes a plurality of the anchor knobs 60 projecting away therefrom and/or a plurality of anchor apertures, similar to the anchor apertures 64 in the base, therein. As such the case 400 may be used separately from the chair 10 for certain exercises if desired. The case 400 may include multiple different compartments (not shown) that can hold the resistance bands 100, the exercise attachments and other paraphernalia used with the exercise chair 10. The case 400 may also store telescoping tubes 110 with sleeves 305, and is preferably strong enough to support the weight of a person standing or sitting on the case 400.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise chair for a person, comprising:

a chair frame that includes a back support frame fixed at a lower end thereof with a back end of a seat frame, each of the back support frame and the seat frame including at least one back support frame upper anchor knob and at least one seat frame upper anchor knob, respectively fixed with a side edge of the back support frame and the seat frame and projecting laterally away from the back support frame and the seat frame;

a base fixed with a lower end of the seat frame and adapted to support the exercise chair on a support surface, the base having at least one lower anchor knob projecting linearly away therefrom;

at least one elastomeric resistance band adapted for selective fixing with any of the at least one back support frame upper anchor knob, the at least one seat frame upper anchor knob and the at least one lower anchor knob;

whereby with the person seated in the chair and the chair resting on the support surface, the at least one resistance band fixed with any of the at least one back support frame upper anchor knob, the at least one seat frame upper anchor knob and at least one lower anchor knob so that the person can exercise by pushing and/or pulling the at least one resistance band, wherein the at least one back support frame upper anchor knob and/or the at least one seat frame upper anchor knob is removably attached to an extension tube extending from the side edge of the back support frame and/or the seat frame, and the at least one lower anchor knob is removably attached to at least one of:

a central vertical shaft of the base, and at least one base leg of a plurality of base legs that extends from the central vertical shaft.

2. The exercise chair of claim 1 further comprising at least one cushion or cover covering at least a portion of at least one of the back support and seat frames.

3. The exercise chair of claim 2 wherein each of the at least one back support frame upper anchor knob and the at least one seat frame upper anchor knob is fixed with the side edge of one of the back support frame and the seat frame respectively, with the extension tube traversing the at least one cover, the at least one back support frame upper anchor knob and the at least one seat frame upper anchor knob projecting laterally away from the at least one cover, and wherein each of the at least one back support frame upper anchor knob and the at least one seat frame upper anchor knob includes a threaded shaft for screwing into a threaded receiver of the extension tube of the side edge of the back support frame and the seat frame.

4. The exercise chair of claim 1 wherein a front side of the seat frame further includes an extendible second T-bar having two opposing ends, each terminating at a T-bar anchor knob or anchor aperture, the second T-bar positionable between a retracted position and an extended position in front of the seat frame.

5. The exercise chair of claim 4 wherein the second T-bar is pivotally attached to the seat frame, such that when the second T-bar is in the extended position, the second T-bar may rotate between a raised position and a lowered position.

6. The exercise chair of claim 1 wherein the central vertical shaft is fixed at a top end thereof with a shaft receiver mechanism fixed with the lower end of the seat frame, a lower end of the central vertical shaft terminating in the plurality of base legs projecting downwardly away therefrom, each base leg adapted for contacting the support surface at a distal end thereof.

7. The exercise chair of claim 1 wherein the at least one elastomeric resistance band includes at least one aperture or slot adapted for selective fixing with any of the at least one back support frame upper anchor knob, the at least one seat frame upper anchor knob and the at least one lower anchor knob.

8. The exercise chair of claim 1 wherein a top side of the back support frame further includes an extendible first T-bar having two opposing ends, each terminating at a T-bar anchor knob or anchor aperture, the first T-bar positionable between a retracted position and an extended position above the back support frame.

9. The exercise chair of claim 1 wherein each of the at least one back support frame upper anchor knob, the at least one seat frame upper anchor knob and the at least one lower anchor knob includes a threaded shaft for screwing into a threaded receiver of the back support frame, the seat frame and the base, respectively.

10. The exercise chair of claim 1 wherein each extension tube is laterally adjustable so that the lateral position of each of the at least one back support frame upper anchor knob and the at least one seat frame upper anchor knob is laterally adjustable.

11. The exercise chair of claim 1 wherein each extension tube comprises a first fixed sleeve and a second inner extendible tube captured within the first fixed sleeve, the second extendible tube including a threaded shaft, whereby the second inner extendible tube is configured to be manually extended or retracted into the first fixed sleeve.

12. The exercise chair of claim 1 further including at least two resistance bands and an attachment bar fixable at each end with one of the two resistance bands, each resistance band of the at least two resistance bands is fixed at an opposing end with one of the at least one back support frame upper anchor knob and the at least one seat frame upper anchor knob, whereby the attachment bar is configured to be pushed or pulled by the person to exercise his arms.

13. The exercise chair of claim 1 further including at least two resistance bands, each having a central curved handle, whereby opposing ends of each resistance band of the at least two resistance bands are configured to be fixed with two back support frame upper anchor knobs at a common side of the back support frame, whereby the person pushes or pulls the central curved handle to exercise his arms.

14. The exercise chair of claim 1 wherein the at least one elastomeric resistance band includes a raised, reinforced section around an aperture therethrough, each of the at least one back support frame upper anchor knob, the at least one seat frame upper anchor knob and the at least one lower anchor knob including a recessed portion cooperative with the raised, reinforced section to rotationally capture the at least one elastomeric resistance band on the at least one back support frame upper anchor knob, the at least one seat frame upper anchor knob or the at least one lower anchor knob when the at least one back support frame upper anchor knob, the at least one seat frame upper anchor knob or the at least one lower anchor knob is fixed with the at least one elastomeric resistance band.

15. The exercise chair of claim 1 further including a removable case selectively fixable with the seat frame, the removable case having a selectively openable side that allows access to an internal storage volume, the case further including a handle on an exterior of the case, the case further including a plurality of anchor knobs projecting away therefrom and/or a plurality of anchor apertures therein.

16. The exercise chair of claim 1 wherein at least one of the at least one back support frame upper anchor knob, the at least one seat frame upper anchor knob and the at least one lower anchor knob includes a capped knob with a waist around which a hook of one of the at least one elastomeric resistance band may be engaged.

17. The exercise chair of claim 1 wherein at least one of the at least one back support frame upper anchor knob, the at least one seat frame upper anchor knob and the at least one lower anchor knob includes an outwardly-projecting loop through which a hook of one of the at least one elastomeric resistance band is configured to be engaged.

18. An exercise chair for a person, comprising:

a chair frame that includes a back support frame fixed at a lower end thereof with a back end of a seat frame, each of the back support frame and the seat frame including at least one back support frame upper anchor knob and at least one seat frame upper anchor knob, respectively fixed with a side edge of the back support frame and the seat frame and projecting laterally away from the back support frame and the seat frame;

a base fixed with a lower end of the seat frame and adapted to support the exercise chair on a support surface, the base having at least one lower anchor knob projecting linearly away therefrom;

at least one elastomeric resistance band adapted for selective fixing with any of the at least one back support upper anchor knob, the at least one seat frame upper anchor knob and the at least one lower anchor knob;

whereby with the person seated in the chair and the chair resting on the support surface, the at least one resistance band can be fixed with any of the at least one back support frame upper anchor knob, the at least one seat frame upper anchor knob and at least one lower anchor knob so that the person can exercise by pushing and/or pulling the at least one resistance band, wherein the at least one back support frame upper anchor knob and/or the at least one seat frame upper anchor knob is removably attached to an extension tube extending from the side edge of the back support frame and/or seat frame, wherein the at least one back support frame upper anchor knob includes at least two back support frame upper anchor knobs, wherein the exercise chair further includes a pair of brackets adapted to engage the at least two back support frame upper anchor knobs, each bracket including a cup extending from a side wall thereof laterally away from the back support frame, each cup facing upright adapted to hold a U-bar attachment rotationally therein, each U-bar attachment fixed together around a back side of the back support frame with the at least one elastomeric resistance band, whereby the person seated in the chair can insert his elbows or forearms into one of the U-bar attachments and squeezed together to exercise the person's arms and pectoral muscles.

19. An exercise chair for a person, comprising:

a chair frame that includes a back support frame fixed at a lower end thereof with a back end of a seat frame, each of the back support frame and the seat frame including at least one back support frame upper anchor knob and the at least one seat frame upper anchor knob, respectively fixed with a side edge of the back support frame and the seat frame and projecting laterally away from the back support frame and the seat frame;

a base fixed with a lower end of the seat frame and adapted to support the exercise chair on a support surface, the base having at least one lower anchor knob projecting linearly away therefrom;

at least one elastomeric resistance band adapted for selective fixing with any of the at least one back support frame upper anchor knob, the at least one seat frame upper anchor knob and the at least one lower anchor knob;

at least one cushion or cover covering at least a portion of at least one of the back support and seat frames, whereby with the person seated in the chair and the chair resting on the support surface, the at least one resistance band can be fixed with any of the at least one back support frame upper anchor knob, the at least one seat frame upper anchor knob and the at least one lower anchor knob so that the person can exercise by pushing and/or pulling the at least one resistance band, wherein the at least one back support frame upper anchor knob and/or the at least one seat frame upper anchor knob is removably attached to an extension tube extending from the side edge of the back support frame and/or the seat frame, wherein the at least one back support frame upper anchor knob and/or the at least one seat frame upper anchor knob is fixed with the side edge of the back support frame and/or the seat frame with the extension tube traversing the at least one cover, the at least one back support frame upper anchor knob and/or the at least one seat frame upper anchor knob projecting laterally away from the at least one cover, and wherein the at least one back support frame upper anchor knob and/or the at least one seat frame upper anchor knob includes a threaded shaft for screwing into a threaded receiver of the extension tube of the side edge of the back support frame and/or the seat frame.

20. The exercise chair of claim 19 wherein each extension tube is laterally adjustable so that the lateral position of each of the at least one back support frame upper anchor knob and the at least one seat frame upper anchor knob is laterally adjustable.

21. The exercise chair of claim 19 wherein each extension tube comprises a first fixed sleeve and a second inner extendible tube captured within the first fixed sleeve, the second extendible tube including the threaded shaft, whereby the second inner extendible tube is configured to be manually extended or retracted into the first fixed sleeve.

* * * * *